United States Patent [19]

Lin et al.

[11] Patent Number: 5,064,544

[45] Date of Patent: Nov. 12, 1991

[54] LIQUID FABRIC CONDITIONER CONTAINING COMPATIBLE AMINO ALKYL SILICONES

[75] Inventors: Samuel Lin, Paramus; Gaznabi Khan, Newark; Lucia Salas, North Bergen, all of N.J.; George Policello, Peekskill, N.Y.

[73] Assignee: Lever Brothers Company, Division of Conopco, Inc., New York, N.Y.

[21] Appl. No.: 532,430

[22] Filed: Jun. 1, 1990

[51] Int. Cl.[5] ..... D06M 13/325; C11D 1/62

[52] U.S. Cl. ..... 252/88; 252/8.6; 252/174.15; 556/424; 556/425

[58] Field of Search ..... 252/8.6, 8.8, 174.15; 556/424, 425

[56] References Cited

U.S. PATENT DOCUMENTS

| | | | |
|---|---|---|---|
| 3,032,577 | 5/1962 | Morehouse | 260/448.2 |
| 3,402,191 | 9/1968 | Morehouse | 260/448.2 |
| 3,624,120 | 11/1971 | Yetter | 252/351 |
| 3,860,709 | 1/1975 | Abbott et al. | 424/184 |
| 4,359,545 | 11/1982 | Ona et al. | 252/8.8 |
| 4,422,949 | 12/1983 | Ooms | 252/8.8 |
| 4,446,033 | 5/1984 | Barrat et al. | 252/8.6 |
| 4,450,152 | 5/1984 | Ona et al. | 424/184 |
| 4,485,090 | 11/1984 | Chang | 424/52 |
| 4,507,455 | 3/1985 | Tangney et al. | 556/421 |
| 4,514,319 | 4/1985 | Kulkarni et al. | 252/321 |
| 4,585,563 | 4/1986 | Busch et al. | 252/174.15 |
| 4,639,321 | 1/1987 | Barrat et al. | 252/174.15 |
| 4,661,267 | 4/1987 | Dekker et al. | 252/8.8 |
| 4,661,269 | 4/1987 | Trinh et al. | 252/8.8 |
| 4,724,089 | 2/1988 | Konig et al. | 252/8.8 |
| 4,757,121 | 7/1988 | Tanaka et al. | 528/27 |
| 4,767,547 | 8/1988 | Straathof et al. | 252/8.8 |
| 4,767,548 | 8/1988 | Kasprzak et al. | 252/8.8 |
| 4,789,491 | 12/1988 | Chang et al. | 252/8.75 |
| 4,800,026 | 1/1989 | Coffindaffer et al. | 252/8.8 |
| 4,806,255 | 2/1989 | Konig et al. | 252/8.8 |
| 4,810,253 | 3/1989 | Kasprzak et al. | 8/137 |
| 4,818,242 | 4/1989 | Burmeister et al. | 8/115.6 |
| 4,879,051 | 11/1989 | Lo et al. | 252/8.8 |
| 4,908,140 | 3/1990 | Bausch et al. | 252/8.8 |
| 4,911,852 | 3/1990 | Coffindaffer et al. | 252/174.15 |
| 4,933,097 | 6/1990 | Keegan | 252/8.6 |
| 4,994,593 | 2/1991 | Lin et al. | 556/424 |

FOREIGN PATENT DOCUMENTS

| | | | |
|---|---|---|---|
| 0255711 | 2/1988 | European Pat. Off. | |
| 0372612 | 6/1990 | European Pat. Off. | 556/424 |
| 1549180 | 6/1976 | United Kingdom | |
| 1447254 | 8/1976 | United Kingdom | |

OTHER PUBLICATIONS

Chemistry and Technology of Silicones.
Introduction to Colloid and Surface Chemistry.
CRC Handbook of Chemistry and Physics; 70th Edition; 1989–1990; pp. C1–C9.

*Primary Examiner*—Paul Lieberman
*Assistant Examiner*—Bradley A. Swope
*Attorney, Agent, or Firm*—Milton L. Honig

[57] ABSTRACT

Liquid fabric conditioning compositions are disclosed. The compositions incorporate compatible organosilicones which form mutually soluble mixtures with common fabric softening agents.

25 Claims, No Drawings

LIQUID FABRIC CONDITIONER CONTAINING COMPATIBLE AMINO ALKYL SILICONES

BACKGROUND OF THE INVENTION

1. Field of the Invention

The instant invention relates to conditioning of fabrics in an aqueous wash bath, to liquid compositions containing fabric conditioning ingredients and to processes for making the compositions.

2. Related Art

Silicones have been applied to fabrics during manufacture of fabrics or during the make up of articles of clothing. With respect to application of silicones to fabrics during a laundry process, Great Britain Patent Application 1,549,180; Burmeister et al., U.S. Pat. No. 4,818,242; Konig et al., U.S. Pat. No. 4,724,089; Konig et al., U.S. Pat. No. 4,806,255; Dekker et al., U.S. Pat. No. 4,661,267 and Trinh et al., U.S. Pat. No. 4,661,269 describe aqueous dispersions or emulsions of certain silicones of limited viscosity incorporated in liquid rinse-cycle fabric softening compositions. A fabric softening composition containing emulsified silicone is also taught by Barrat et al. in U.S. Pat. No. 4,446,033. Coffindafer et al., U.S. Pat. No. 4,800,026 discloses fabric care compositions containing curable amine functional silicones.

The compositions disclosed in the art contain individual particles of a silicone and individual particles of a fabric softening agent.

In the present invention the dispersed particle is a composite particle containing a mutually soluble mixture of a silicone and a fabric softening component. Compatible organosilicones described herein form mutually soluble mixtures with certain types of commonly used fabric softening agents. Critically, the organosilicones in the dispersed composite particles do not separate from fabric softening agents during processing or on standing. An additional advantage afforded by the present invention is a simplified manufacture of fabric dispersed separately and can be introduced into the composition simultaneously with a fabric softener.

Another advantage of using compatible silicones is that compatible silicones enhance the spreading of the fabric softening agents on the fabric surface as compared to the spreading of the fabric softening agents alone or in combination with incompatible silicones. As a result of the use of compatible silicones as described herein greater, more complete surface coverage by a fabric softening agent is achieved with a further advantage of smaller dosage requirements.

Accordingly, it is an object of the present invention to provide a liquid fabric conditioning composition which contains composite particles of a mutually soluble mixture of a fabric softening component and an organosilicone.

It is a further object of the invention to provide processes by which the aforementioned composition can be manufactured.

These and other objects and advantages will appear as the description proceeds.

SUMMARY OF THE INVENTION

The present invention is based, in part, on the discovery that specific silicones, defined herein as compatible, are capable of forming mutually soluble mixtures with certain conventional fabric softening agents.

It is important to differentiate between compatible and incompatible silicones and between mutually soluble and insoluble mixtures of silicones and fabric softeners. Mutual solubility as taught herein is critical and is ascertained by the appearance of the mixture of a silicone and a fabric softener. When a silicone and a fabric softener are heated and mixed together, the resulting liquid mixtures are either transparent or opaque. In the transparent mixtures, silicone and fabric softener are mutually soluble and are, accordingly, suitable for use in the present invention. In the opaque mixtures, silicone and fabric softener are mutually insoluble and the mixtures are thus not suitable for use in the present liquid compositions. However, these opaque mixtures are sometimes sufficiently stable for use as a coating for a dryer sheet application.

In its broadest aspect, the objects of the invention are accomplished by a liquid fabric conditioning composition which includes about 1% to about 60% of composite particles containing a mutually soluble mixture of a fabric softening component and an organosilicone. Of course, these particles can also be added to a liquid containing other fabric treating ingredients, including for example, softeners.

The fabric softening component employed herein may be any commonly used fabric softening agent complying with the above conditions provided that it must include at least a portion of cationic quaternary ammonium salts either used singly or, optionally, in admixture with other softening agents such as nonionic softeners selected from the group of tertiary amines having at least one $C_{8-30}$ alkyl chain, esters of polyhydric alcohols, fatty alcohols, ethoxylated fatty alcohols, alkyl phenols, ethoxylated alkylphenols, ethoxylated fatty amines, ethoxylated monoglycerides, ethoxylated diglycerides, mineral oils, polyols, carboxylic acids having at least 8 carbon atoms, and mixtures thereof.

DETAILED DESCRIPTION OF THE INVENTION

The fabric conditioning composition of the present invention includes a cationic quaternary ammonium salt. The counterion is methyl sulfate or any halide.

Examples of cationic quaternary ammonium salts include, but are not limited to:

(1) Acyclic quaternary ammonium salts having at least two $C_8$ to $C_{30}$, preferably $C_{12}$ to $C_{22}$ alkyl chains, such as: ditallowdimethyl ammonium chloride, di(hydrogenated tallow)dimethyl ammonium chloride, distearyldimethyl ammonium chloride, dicocodimethyl ammonium chloride and the like;

(2) Cyclic quaternary ammonium salts of the imidazolinium type such as di(hydrogenated tallow)-dimethyl imidazolinium methyl sulfate, 1-ethylene-bis(2-tallow-1-methyl) imidazolinium methyl sulfate and the like;

(3) Diamido quaternary ammonium salts such as: methyl-bis(hydrogenated tallow amidoethyl)-2-hydroxyethyl ammonium methyl sulfate, methyl-bis(tallowamidoethyl)-2-hydroxypropyl ammonium methyl sulfate and the like;

(4) Biodegradable quaternary ammonium salts such as N,N-di(tallowoyl-oxy-ethyl)-N,N,-dimethyl ammonium chloride, and N,N-di(tallowoyl-oxy-propyl)-N,N-dimethyl ammonium chloride and the like. When fabric conditioning compositions employ biodegradable quaternary ammonium salts, the pH of the composition is preferably adjusted to between about 2 and about 5.

Biodegradable quaternary ammonium salts are described, for example, in U.S. Pat. Nos. 4,767,547 and 4,789,491 incorporated by reference herein.

(5) Mixtures of water-insoluble cationic fabric softeners and polyalkoxylated ammonium salts as described in U.S. Pat. No. 4,422,949 incorporated by reference herein. Such mixtures are particularly suitable for incorporation in concentrated form of the liquid compositions herein.

The fabric softening component may include other fabric softeners in addition to the cationic quaternary ammonium salts. Additional fabric softeners suitable for use herein can be selected from the following classes of compounds:

(i) Tertiary fatty amines having at least one and preferably two $C_8$ to $C_{30}$, preferably $C_{12}$ to $C_{22}$ alkyl chains. Examples include hardened tallow amine and cyclic amines such as 1-(hydrogenated tallow)amidoethyl-2-(hydrogenated tallow) imidazoline. Cyclic amines which may be employed for the compositions herein are described in U.S. Pat. No. 4,806,255 incorporated by reference herein.

(ii) Carboxylic acids having 8 to 30 carbon atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic and myristic acids are preferred fatty acids for use in the composition herein. Examples of these carboxylic acids are commercial grades of stearic acid and the like which may contain small amounts of other acids.

(iii) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

(iv) Fatty alcohols, ethoxylated fatty alcohols, alkylphenols, ethoxylated alkyl phenols, ethoxylated fatty amines, ethoxylated monoglycerides and ethoxylated diglycerides.

(v) Mineral oils, and polyols such as polyethylene glycol.

(vi) Condensation products of higher fatty acids with polyamines, selected from the group consisting of hydroxylalkyl alkylene diamines, dialkylene triamines and mixtures thereof, as described in U.S. Pat. No. 4,661,269, the disclosure of which incorporated by reference herein.

Preferred fabric softeners for use herein are acyclic quaternary ammonium salts, ditallowdimethyl ammonium chloride being most preferred for fabric conditioning compositions of this invention. Especially preferred are mixtures of ditallowdimethyl ammonium chloride with fatty acids, particularly stearic acid or myristic acid.

About 1% to about 40% of the fabric softening component is used in the compositions of the invention. There must be included at least a sufficient amount of quaternary ammonium salt to achieve anti-static effect, for example, about 1% to 3% in the dilute product and about 2% to about 5% in the concentrated product. On the other hand, the entire fabric softening component may be quaternary ammonium salt. The diluted version of the product contains about 1% to about 12%, preferably about 3% to about 10% and most preferably about 4% to about 7% of the fabric softening component. The concentrated version of the product contains about 13% to about 40%, preferably about 13% to 30% and most preferably about 13% to about 20% of the fabric softening component.

Silicone

The second essential ingredient of the fabric softening composition employed in the present invention is a compatible organosilicone.

The organosilicones employed in the present invention (also termed herein as compatible silicones) are capable of forming mutually soluble mixtures with the fabric softeners listed above.

The organosilicones employed herein have a $\%CH_2$ content of about 25% to about 90%. The $\% CH_2$ content is defined as $$\% CH_2 = \frac{\text{number of methylene } (CH_2) \text{ groups}}{\text{number of methylene groups and methyl groups}} \times 100\%$$

The organosilicones included in the fabric conditioning compositions of the invention contain at least one unit of Formula A:

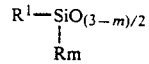

wherein m is a number from 0 to 2 and R is a mono valent hydrocarbon radical.

The value of $(3-m)/2$ in Formula A means the ratio of oxygen atoms to silicon atoms, i.e. $SiO_{\frac{1}{2}}$ means one oxygen is shared between two silicon atoms.

$R^1$ in Formula A is selected from the group consisting of: i) a hydrocarbon radical having from 6 to 45 carbon atoms, preferably from 8 to 18 carbon atoms and which may be saturated, unsaturated, cyclic, acyclic, alkyl or aromatic;

ii) a unit of Formula A1

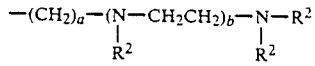

wherein a is a number of at least 1, preferably 3; b is a number from 0 to 10, preferably 1; $R^2$ is

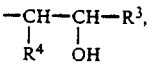

$R^3$ is a hydrocarbon radical having from 4 to 40 carbon atoms preferably from 8 to 18 carbon atoms and may be saturated, unsaturated, cyclic, acyclic, alkyl or aromatic; and $R^4$ is hydrogen or a hydrocarbon radical having from 1 to 40 carbon atoms, preferably hydrogen; and iii) a unit of Formula A2

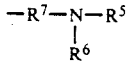

wherein $R^5$ and $R^6$ are independently selected from hydrogen or a hydrocarbon radical having from 1 to 45 carbon atoms which may be saturated, unsaturated, cyclic, acyclic, alkyl or aromatic and at least one of $R^5$ and $R^6$ is a hydrocarbon radical having from 6 to 45 carbon atoms, $R^7$ is $$-R^8-\underset{\underset{OH}{|}}{CH}-CH_2-,$$

wherein $R^8$ is a divalent organic radical having from 1 to 12 carbon atoms which may be saturated, unsaturated, cyclic, acyclic, alkyl or aromatic, and preferably is $-CH_2CH_2CH_2-O-CH_2-$.

Thus, organosilicones employed in the present invention include alkylsilicones and alkylaminosilicones which satisfy the structural parameters described above and which have % methylene (%$CH_2$) content of about 25% to about 90%. Mutual solubility of the organosilicones herein with fabric softening agents depends, in part, on the %$CH_2$ content of the organosilicones. The preferred range of the %$CH_2$ content for the silicones herein is from about 40% to about 90%, more preferably from about 50% to about 85%, and most preferably from about 50% to about 75% to ensure mutual solubility of the mixtures containing relatively large amounts of silicone.

The organosilicones included in the compositions herein may be linear, branched, or partially crosslinked, preferably linear, and may range from fluid, liquid to viscous liquid, gum and solid.

An example of an alkylsilicone suitable for use herein is:

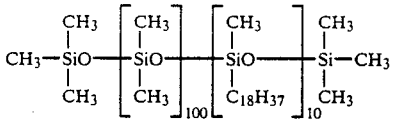

An example of a suitable alkylaminosilicone containing the unit of Formula A1 is:

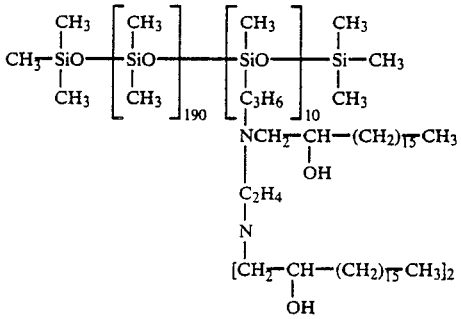

An example of an alkylaminosilicone containing the unit of Formula A2 is:

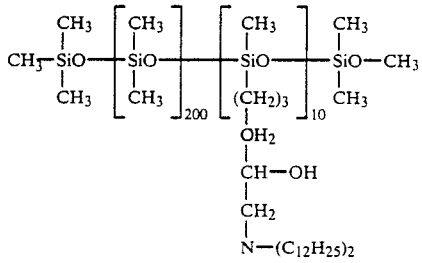

Alkylsilicones employed in this invention may be produced by reacting a hydrosiloxane co-polymer with a hydrocarbon having 6 to 45 carbon atoms and having a terminal vinyl functionality. Such reactions are described, for example, in Chemistry and Technology of Silicones by Walter Noll, Academic Press, N.Y. (1968), pages 49–51 and 219–226. Commercially available alkylsilicones suitable for use herein are, for example, Masil 264, Masil 265, Masil 265 HV from Mazer International Corp. or ABIL - Wax 9800/or ABIL - Wax 9801 from Th. Goldschmidt AG.

Alkylaminosilicones employed in this invention may be produced by 1) treating silicones containing primary or secondary amine functional groups with epoxides such as ethylene oxide to form alkylaminosilicones having the unit of Formula A1, or 2) by treating epoxysilicones with primary or secondary amines such as dicocoamine to form alkylaminosilicones having the unit of Formula A2.

The modified alkylaminosilicones of the invention having the unit of Formula A1 may be prepared by mixing epoxide compounds with aminosilicones in a pressure reactor and heating for about 24 hours, after which the unreacted epoxide compound is vacuum stripped off. The amount of epoxide to be used is calculated based upon the number of amine functional groups on the alkylaminosilicone. Preferably, two epoxides are reacted for every primary amine and one epoxide for every secondary amine, in order to convert them to tertiary amines. A stoichiometric amount or up to 25% excess of epoxide can be used. The reaction is preferably conducted between 25° C. and 150° C., especially between 50° C. and 100° C. The pressure is preferably maintained from 50 psi to 300 psi, particularly from 50 psi to 150 psi. Typical aminosilicone starting compounds would include Dow Corning Q2-8075. The art of making alkylaminosilicones having the unit of Formula A1 is disclosed in Examples 1 and 2 herein and in the copending patent application of Lin et al. entitled "Hydroxylhydrocarbyl Modified Aminoalkyl Silicones", Ser. No. 449,360 filed Dec. 6, 1989.

The modified alkylaminosilicones having the unit of Formula A2 may be prepared by mixing epoxysilicones, secondary amines, and a solvent such as isopropanol or toluene, and heating the mixture at reflux for about 24 hours, after which the solvent is removed by distillation or vacuum stripping. The amount of amine to be used is calculated based upon the number of epoxy functional groups on the epoxysilicone. Preferably, one secondary amine is reacted for every epoxy functional group in order to convert the amine to tertiary amine. A stoichiometric amount or up to 25% excess of amine can be used. The reaction is preferably conducted between 50° C. and 150° C., especially between 75° C. and 110° C. The reaction is preferably conducted at atmospheric pressure, but may be conducted in a pressure reactor with the pressure being maintained from 50 psi to 300 psi.

The modified alkylaminosilicones employed in this invention contain amine groups which may be quaternized with, for example, alkyl halide or methyl sulfate, or may be protonated with a Lewis acid such as hydrochloric acid, acetic acid, citric acid, formic acid and the like.

Alkylsilicones and alkylaminosilicones employed herein may, in addition to the units of Formula A, contain secondary units selected from the group consisting of a unit of Formula B1 and a unit of Formula B2:

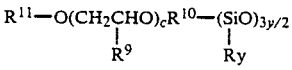

Formula B1

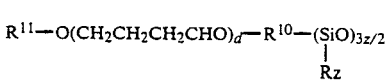

Formula B2 wherein $R^{11}$ is a hydrocarbon radical having from 1 to 40 carbon atoms, preferably is $CH_3$; $R^9$ is a hydrocarbon radical having from 1 to 3 carbon atoms; is oxygen or alkylene having from 1 to 8 carbon atoms, preferably propylene; c and d are numbers from 0 to 50, preferably 2 to 15; and y and z are numbers from 0 to 2.

Organosilicones preferred for use herein have a $\%CH_2$ content of about 40% to about 90% and are either alkylaminosilicones having the unit of Formula A1 or alkylsilicones.

The amount of organosilicone employed herein generally ranges from about 0.1% to about 20%, and is preferably at least about 0.5% to about 2% to maximize the spreading of the fabric softeners on fabric surface, but could be higher in concentrated liquids. The amount of the organosilicone is governed by the ratio at which the mutually soluble mixture of the fabric softening component and the organosilicone is formed.

The weight ratio of the organosilicone to the fabric softening component in the fabric conditioning compositions employed herein is from about 100:2 to about 1:100, preferably from about 2:100 to about 20:100, but must be such that a mutually soluble mixture can be formed.

As described above, mutually soluble mixtures are transparent. Transparent mixtures are defined herein as mixtures having about 90% transmittance when measured with a visible light probe (1 centimeter path length) against distilled water background using a Brinkman PC 800 colorimeter. Mutual solubility of the fabric softening component and the organosilicone herein depends on the structure and the $\%CH_2$ content of the organosilicone and the particular fabric softeners employed in the mixture. The optimum concentration and molecular structure of the organosilicone are easily selected by checking the transparency of the mixture.

If either the fabric softener or the silicone is a solid at room temperature, it is melted before mixing and the transparency of the mixture is checked above the melting point of the fabric softener or the silicone. Thus, mutual solubility is defined herein with respect to liquid or liquefied mixtures of the organosilicone and the fabric softening component. Preferably, the silicone and the fabric softener are mutually soluble at a silicone concentration of at least about 2%.

The fabric conditioning compositions of the invention include a liquid carrier, which is water and which may additionally contain organic solvents such as lower alcohols selected from, for example, methyl alcohol, ethyl alcohol and isopropanol. Both the diluted and the concentrated versions of the product are preferably dispersions of the active ingredients in the water solvent matrix.

The organosilicone and the fabric softening component which have been ascertained to form a mutually soluble mixture are heated and mixed and the resulting mutually soluble mixture is dispersed to form composite particles of the fabric softening component and the organosilicone in a liquid carrier. Of course, the materials can also be spray dried to form discrete composite softener particles, which may also be dispersed in liquid or other forms of product. The composite particles typically form about 1% to about 60% of the fabric conditioning composition of the invention, preferably about 1% to about 30%, and most preferably about 1% to about 20%. Remaining fabric softening component and organosilicone may be dispersed separately without forming a mutually soluble mixture.

Various additives may be used in combination with the composite particles. These include small amounts of incompatible silicones, such as predominantly linear polydialkylsiloxanes, e.g. polydimethylsiloxanes; alkyl quaternary ammonium salts having one $C_{8-30}$ alkyl chain; soil release polymers such as block copolymers of polyethylene oxide and terephthalate; fatty amines selected from the group consisting of primary fatty amines, secondary fatty amines, tertiary fatty amines and mixtures thereof; amphoteric surfactants; smectite type inorganic clays; anionic soaps, zwitterionic quaternary ammonium compounds; and nonionic surfactants.

Other optional ingredients include emulsifiers, electrolytes, optical brighteners or fluorescent agents, buffers, perfumes, colorants, germicides and bactericides.

The fabric conditioning compositions of the invention can be used in the rinse cycle of a conventional home laundry operation. Generally, rinse water has a temperature of from about 5° C. to about 70° C.. The concentration of the total active ingredients is generally from about 2 ppm to about 1000 ppm, preferably from about 10 ppm to about 500 ppm, by weight of the aqueous rinsing bath. When multiple rinses are used, the fabric conditioning composition is preferably added to the final rinse.

The following Examples will more fully illustrate the embodiments of this invention. All parts, percentages and proportions referred to herein and in the appended claims are by weight of the composition unless otherwise indicated.

Examples 1–6 include organosilicones within the scope of the present invention having formulas A, B, C and D:

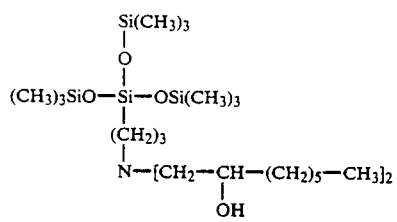

Formula A

-continued

FORMULA B

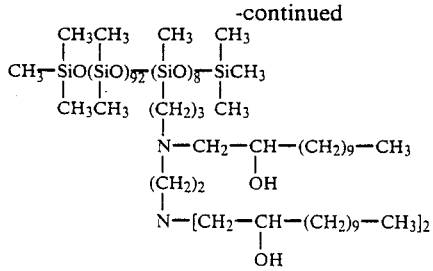

FORMULA C

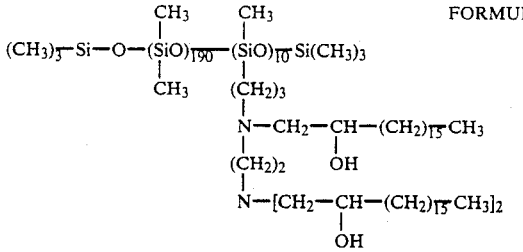

FORMULA D

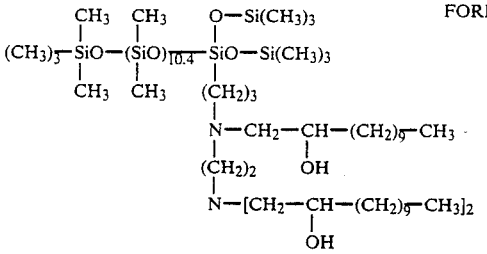

EXAMPLE 1

The silicone of Formula C is a reaction product of the starting aminosilicone (where the nitrogen-containing branch chain is $-(CH_2)_3-NH-(CH_2)_2NH_2$) and 1,2 epoxyoctadecane. The compound was prepared by placing the starting aminosilicone (61.16 g), 1,2 epoxyoctadecane (38.84 g) and 2-propanol (60.0 g) in a reaction vessel and heating to 80° C. for 24 hours. The reaction vessel consisted of a three neck round bottom flask containing a stirrer, a reflux condenser and a thermometer. The 2-propanol was then stripped off with a $N_2$ sparge at 100° C. as described in the Lin et al. application mentioned above.

Formula C silicone has $\%CH_2$ equal 56.62.

EXAMPLE 2

A "T" structure modified alkylaminosilicone of Formula D, having $\%CH_2$ equal 52.50 was prepared. In the starting aminoalkylsilicone, the nitrogen-containing branch chain is $-(CH_2)_3-NH-(CH_2)_2NH_2$. In the modified aminoalkylsilicone hydrogens on nitrogens were replaced with $$-CH_2\underset{\underset{OH}{|}}{CH}-(CH_2)_9CH_3.$$

In the process, 34.7 g of the starting aminoalkylsilicone, 34.4 g 1,2-epoxydodecane and 17.4 g 2-propanol were charged to the reaction vessel following the procedures of Example 1.

EXAMPLE 3

Effect of the $\%CH_2$ content of various silicones as indicated in Table I on the mutual solubility with Adogen 442 (dihydrogenatedtallow dimethyl ammonium chloride from Sherex Corp.) was investigated. Samples were prepared by mixing the silicones with Adogen 442 above the melting point of Adogen 442. All mixtures initially contained 5% silicone by weight of the mixture. A clear liquid mixture indicates mutual solubility and such mixture is suitable for use in the present invention.

The results that were generated are summarized in Table I. Samples 6 and 7 were synthesized in Examples 1 and 2 respectively.

TABLE I

| # | Silicone | % $CH_2$ | Solubility |
|---|---|---|---|
| 1. | DC 200[1] | 0 | no |
| 2. | DC SSF[2] | 0 | no |
| 3. | Formula A | 56.69 | yes |
| 4. | Formula B | 57.61 | yes |
| 5. | Formula B, protonated | 57.61 | yes |
| 6. | Formula C | 56.62 | yes |
| 7. | Formula D | 52.50 | yes |

[1]Linear polydimethylsiloxane, supplied by Dow Corning, viscosity = 1000 cst
[2]Aminosilicone supplied by Dow Corning, amine neutral equivalent = 2000, viscosity = 130 cst.

Silicones of samples 3–7 were mutually soluble with Adogen 442 at silicone concentration of 5% by weight of the mixture. However, silicones 1 and 2, which are not within the scope of the present invention, were not compatible with Adogen 442 at 5% or even at 25% of silicone.

EXAMPLES 4–6

Contact Angle Measurements

Contact angle values reflect the spreading behavior of a liquid on a solid surface. Discussion of the relationship between contact angle values and spreading is provided, for example, in Chapter 6 of "Introduction to Colloid and Surface Chemistry", Duncan J. Shaw, Butterworth, 1985. A contact angle of a liquid on solid surface is the angle between the tangent of the droplet and the surface. A smaller contact angle indicates better spreading on the surface. When it is desired to measure the contact angle on fabrics, there is an experimental problem of accurately measuring the true contact angle: due to the surface roughness of the fabric it is difficult to obtain an accurate baseline. Thus, the true contact angle measurements were obtained using cellulose paper.

Samples were prepared by mixing a fabric softener and a silicone above the melting point. A droplet of the melt liquid was applied to a piece of cellulose filter paper. After the droplet cooled and solidified, an initial contact angle was measured. The cellulose paper with the droplet was then placed in a 70° C. oven for 30 minutes in order for the equilibrium contact angle to be achieved. The paper was then removed from the oven and a final contact angle was measured.

The contact angle was measured using a contact angle goniometer (Ramé—Hart model 100). The cellulose with the drop of active was placed on the stage and viewed with a microscope. With the light source on, the drop appeared as a silhouette against a soft, green background. The drop/cellulose interface was alligned with the horizontal crosshair, and the contact angle was determined by rotating the read-out crosshair to tangency with the drop right profile. The contact angle value was then read directly on the graduated goniometer scale. This procedure was repeated to read the contact angle on the left side. Both sides should give the same reading otherwise the sample was not leveled correctly and the stage height should be readjusted.

EXAMPLE 4

Effect of various silicones as indicated in Table II on the spreading of Adogen 442 was investigated. The true contact angle (initial and final) of the mixtures of silicones and Adogen 442 prepared in Example 3 was measured on cellulose paper as described above. Additionally, spreading of the mixtures on cotton fabric was evaluated qualitatively, using a score of 1 to 4: 1=best spreading, 2=moderate spreading, 3=droplet starting to wet the surface, 4=no spreading, droplet beading up. Sample 1 contained only Adogen 442 without any silicone and was used as a control.

The results that were generated are summarized in Table II.

TABLE II

| Sample No. | Silicone | Cotton | Cellulose Initial | Cellulose Final |
|---|---|---|---|---|
| 1 | none | 4 | 110 | 112 |
| 2 | DC200 | 4 | 110 | 147 |
| 3 | DCSSF | 4 | 95 | 132 |
| 4 | Formula A | 1 | 70 | 18 |
| 5 | Formula B | 2-3 | 72 | 59 |
| 6 | Formula B, protonated | 2 | 59 | 21 |
| 7 | Formula C | 2-3 | 86 | 57 |
| 8 | Formula D | 1 | 47 | 60 |

Initial and final contact angles for samples 4–8 containing compatible silicones within the scope of the invention were lower than contact angles for samples 1–3. Silicones of samples 4–8 were shown to form mutually soluble mixtures with Adogen 442 in Example 3.

Samples 1–3 contained either no silicone or silicones which are not within the scope of the invention. The results established that, in mutually soluble mixtures of compatible silicones and fabric softener as taught by the present invention, compatible silicones improve the spreading of the fabric softener on a cellulose surface. Qualitative evaluation of spreading on cotton showed the same pattern of improved spreading when compatible silicones within the scope of the invention were used.

EXAMPLE 5

The concentration effect of various silicones as indicated in Table III on the spreading of Adogen 442 fabric softener was investigated by measuring the contact angle on a cellulose surface using the procedure described above.

TABLE III

| Sample No. | Silicone | Final Contact Angle at % Silicone of 1.5% | 3.5% | 7.5% |
|---|---|---|---|---|
| 1 | DC200 | 147 | 147 | 147 |
| 2 | Formula B | 118 | 55 | — |
| 3 | Formula B, protonated | 48 | 20 | 20 |
| 4 | Formula D | 42 | — | 55 |
| 5 | Formula D, protonated | 98 | 78 | 5 |

This example demonstrates that in Samples 2–5 containing organosilicones within the scope of the invention as little as about 2% by weight of the mixture is needed to reduce the contact angle to improve the spreading on the surface.

Further increase in silicone concentration in Samples 2–5 further reduced the contact angle, indicating even better spreading on the surface.

Silicone of sample 1 which is not suitable for the present invention did not reduce the contact angle of the fabric softener regardless of the amount of the silicone used.

EXAMPLE 6

Mixtures of various silicones as indicated in Table IV with nonionic fabric softeners, such as mineral oil were investigated. The spreading of the mixtures on cotton and polycotton fabrics was investigated by measuring the fabric area (centimeters$^2$) per gram of mineral oil spread on the fabrics.

All samples contained 5% by weight of the mixture of a silicone. The mineral oil used was Semtol 350 from Witco Corp.

TABLE IV

| Sample No. | Silicone | Viscosity (cst) | Surface Tension (dyne/cm) | Fabric Area Cotton | Fabric Area Poly-cotton |
|---|---|---|---|---|---|
| 1 | none | 105 | 32.0 | 303 | 371 |
| 2 | Formula B | 295 | 22.9 | 227 | 224 |
| 3 | Formula D | 182 | 22.2 | 326 | 522 |

Formula B silicone was only partially soluble in mineral oil, while Formula D silicone formed a mutually soluble mixture with mineral oil, demonstrating that the mutual solubility of the silicones and fabric softeners depends on the particular fabric softener as well as the $\%CH_2$ of the silicone.

Silicones B and D both reduced the surface tension of mineral oil as observed in the absence of silicones in sample 1. However, fabric area coverage was increased only in sample 3 where a mutually soluble mixture was formed.

EXAMPLES 7–8

Examples 7–8 include organosilicones within the scope of the invention having formulas E, F and G.

FORMULA E

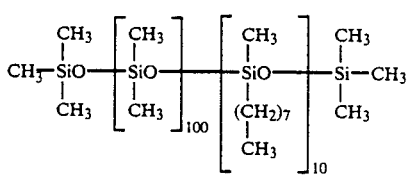

FORMULA F

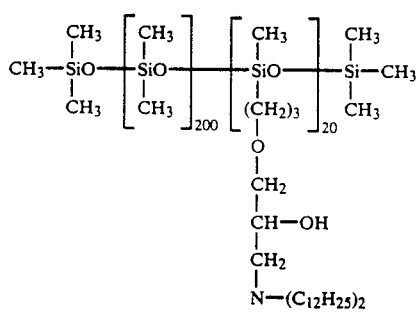

-continued

FORMULA G

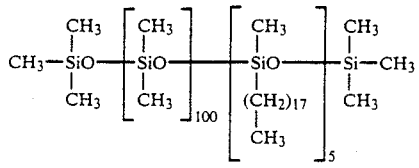

EXAMPLE 7

The mutual solubility of organosilicones with mixtures of fabric softening agents was investigated in the following formulations:

| Formulation No. | Fabric Softening Component Mixture |
|---|---|
| I | 10% Varisoft 475[1]<br>10% Mineral Oil |
| II | 10% Adogen 442<br>1% Myristic Acid |
| III | 11.7% Varisoft 445[2]<br>3.5% Stearic Acid |

[1]Varisoft 475 = Methyl-1-tallowamidoethyl-2-tallow imidazolinium methyl sulfate
[2]Varisoft 445 = Methyl-1-hydrogenated tallowamidoethyl-2-tallow imidazolinium methyl sulfate The fabric softening mixtures of Formulations I, II and III above were heated and melted at approximately 80° C. Various silicones as indicated in Table V were added, with stirring, until the resulting mixture became hazy. At this point, the % silicone added was recorded as solubility of the silicone in the formulation. The results that were generated are summarized in Table V.

TABLE V

| Formulation No. | Silicone Solubility (%) | | |
|---|---|---|---|
| | PDMS[1] | Silicone E | Silicone F |
| I | 0.26 | 1.28 | 4.70 |
| II | 0.34 | 0.69 | 3.10 |
| III | 0.39 | 1.69 | 15.58 |

[1]PDMS = Polydimethylsiloxane, viscosity = 10,000 cst

Silicones E and F were significantly more soluble in Formulations I, II and III than PDMS.

EXAMPLE 8

Various silicones within the scope of the invention as indicated in Table VI were incorporated into liquid fabric conditioning compositions. Fabric softening agents and silicones were mixed together at 80° C. (above the melting point) and then dispersed into water at 60° C.–80° C. to form liquid compositions containing composite particles of the fabric softening component and the silicone.

The resulting compositions are summarized in Table VI.

TABLE VI

| Ingredients | Sample | | | | | | | |
|---|---|---|---|---|---|---|---|---|
| | A | B | C | D | E | F | G | H |
| Adogen 442 | 7.3 | 7.3 | — | — | — | 13.3 | — | — |
| Varisoft 475 | — | — | 10 | 10 | 10 | — | — | — |
| Varisoft 445 | — | — | — | — | — | — | 11.7 | 11.7 |
| Neodol 23[1] | 0.94 | 0.94 | — | — | — | — | — | — |
| Siponic L7-90[2] | 0.94 | 0.94 | — | — | — | — | — | — |
| Mineral oil | — | — | 10 | 10 | 10 | — | — | — |
| Myristic acid | — | — | — | — | — | 1.25 | — | — |
| Stearic acid | — | — | — | — | — | — | 3.5 | 3.5 |
| Silicone E | 0.119 | — | 0.2 | — | — | 0.131 | 0.213 | — |

TABLE VI-continued

| Ingredients | Sample | | | | | | | |
|---|---|---|---|---|---|---|---|---|
| | A | B | C | D | E | F | G | H |
| Silicone G | — | 0.1 | — | 0.2 | — | — | — | — |
| Silicone F | — | — | — | — | 0.2 | — | — | 1.9 |
| Water | 90.7 | 90.7 | 79.8 | 79.8 | 79.8 | 85.3 | 84.6 | 82.9 |

[1]Neodol 23 = Lauryl alcohol
[2]Siponic L-7-90 = $C_{12}H_{25}$—$(OCH_2CH_2)_{12}OH$, from Alcolac.

Samples C, D, E, G, and H were further tested for their softening properties. Terry cloths were prewashed with a solution of Neodol 25-9 (alcohol ethoxylate from Shell Corp.) and $Na_2CO_3$ to remove textile finishes on the surface, rinsed with the samples in a Tergotometer and then line-dried. The cloth load was 20 g per liter and the active concentration was 0.1 g per liter of rinse liquid. The control was rinsed with only water. Using paired comparison, a panel of 20 judges assessed the softness of the treated cloth vs. control. All panelists preferred the treated cloths over the control in all tests.

This invention has been described with respect to certain preferred embodiments and various modifications thereof will occur to persons skilled in the art in the light of the instant specification and are to be included within the spirit and purview of this application and the scope of the appended claims.

What is claimed is:

1. A liquid fabric conditioning composition comprising about 1% to about 60% of composite particles consisting of a mutually soluble mixture consisting of:

a) about 1% to about 40% by weight of the conditioning composition of a fabric softening component comprising a cationic quaternary ammonium salt; and b) about 0.1% to about 20% by weight of the conditioning composition of an organosilicone having a $\%CH_2$ content of about 25% to about 90% and having at least one unit of Formula A:

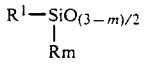

wherein m is a number from 0 to 2, R is a mono valent hydrocarbon radical and $R^1$ is selected from the group consisting of:

i) a unit of Formula A1

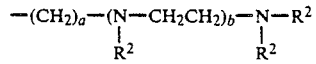

wherein a is a number of at least 1, b is a number from 0 to 10, $R^2$ is

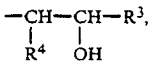

$R^3$ is a hydrocarbon radical having from 4 to 40 carbon atoms and $R^4$ is hydrogen or a hydrocarbon radical having from 1 to 40 carbon atoms; and ii) a unit of Formula A2

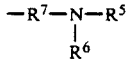

wherein $R^5$ and $R^6$ are independently selected from hydrogen or a hydrocarbon radical having from 1 to 45 carbon atoms and at least one of $R^5$ and $R^6$ is a hydrocarbon radical having from 6 to 45 carbon atoms, $R^7$ is $$-R^8-\underset{\underset{OH}{|}}{CH}-CH_2-,$$

where $R^8$ is a divalent organic radical having from 1 to 12 carbon atoms.

2. The composition of claim 1 wherein the $\%CH_2$content of said organosilicone is about 40% to about 90%.

3. The composition of claim 1 wherein an amount of said organosilicone is about 2% to about 20% by weight of said composition.

4. The composition of claim 1 wherein $R^1$ includes from 8 to 18 carbon atoms.

5. The composition of claim 1 wherein a is 3 and b is 1.

6. The composition of claim 1 wherein $R^3$ includes from 8 to 18 carbon atoms.

7. The composition of claim 1 wherein $R^4$ is hydrogen.

8. The composition of claim 1 wherein m is 1.

9. The composition of claim 1 wherein $R^8$ is $-(CH_2)_3-O-CH_2-$.

10. The composition of claim 1 wherein at least one nitrogen atom of said unit of Formula A1 is protonated or quaternized.

11. The composition of claim 1 wherein the nitrogen atom of said unit of Formula A2 is protonated or quaternized.

12. The composition of claim 1 wherein said cationic quaternary ammonium salt is selected from the group consisting of acyclic quaternary ammonium salts having at least two $C_{8-30}$ alkyl chains, quaternary imidazolinium salts, diamido quaternary ammonium salts, biodegradable quaternary ammonium salts and mixtures thereof.

13. The composition of claim 1 wherein said fabric softening component further comprises nonionic fabric softeners selected from the group consisting of tertiary amines having at least one $C_{8-30}$ alkyl chain, esters of polyhydric alcohols, fatty alcohols, alkyl phenols, ethoxylated fatty alcohols, ethoxylated alkyl phenols, ethoxylated monoglycerides, ethoxylated diglycerides, ethoxylated fatty amines, mineral oils, polyols, carboxylic acids having at least 8 carbon atoms and mixtures thereof.

14. The composition of claim 13 wherein said nonionic softener is a fatty tertiary amine having two $C_{8-30}$ alkyl chains.

15. The composition of claim 14 wherein said fatty tertiary amine is selected from the group consisting of di(hydrogenated)tallowmethylamine, and dihydrogenatedtallowimidazoline.

16. The composition of claim 13 wherein said nonionic softener is selected from the group consisting of glycerol stearate and a sorbitan ester.

17. The composition of claim 13 wherein said carboxylic acid is stearic acid.

18. The composition of claim 1 wherein said quaternary ammonium salt is selected from the group consisting of dihydrogenatedtallowdimethyl ammonium chloride and dihydrogenatedtallowimidazolinium chloride.

19. The composition of claim 1 wherein said organosilicone further comprises at least one secondary unit selected from the group consisting of:

i) a unit of Formula B1

$$R^{11}-O(\underset{\underset{R^9}{|}}{CH_2CHO})_cR^{10}-(\underset{\underset{Ry}{|}}{SiO})_{3y/2}$$

and ii) a unit of Formula B2

$$R^{11}-O(CH_2CH_2CH_2CH_2O)_d-R^{10}-(\underset{\underset{Rz}{|}}{Si}-O)_{3z/2}$$

wherein $R^9$ is a hydrocarbon radical having from 1 to 3 carbon atoms; $R^{10}$ is oxygen or a hydrocarbon radical having from 1 to 8 carbon atoms; $R^{11}$ is a hydrocarbon radical having from 1 to 40 carbon atoms; c and d are numbers from 0 to 50; and y and z are numbers from 0 to 2.

20. The composition of claim 19 wherein $R^{11}$ is methyl.

21. The composition of claim 19 wherein $R^{10}$ is propylene.

22. The composition of claim 19 wherein the $\%CH_2$ content of said organosilicone is about 40% to about 90%.

23. The composition of claim 19 wherein $R^1$ is a hydrocarbon radical having from 8 to 18 carbon atoms.

24. Method for softening fabrics comprising treating said fabrics in an aqueous bath with the fabric conditioning composition of claim 1.

25. Discrete composite particles consisting of a mutually soluble mixture consisting of:

a) at least about 1% of a fabric softening component comprising a cationic quaternary ammonium salt; and b) an organosilicone having a $\%CH_2$ content of about 25% to about 90% and having at least one unit of Formula A:

$$R^1-\underset{\underset{Rm}{|}}{SiO}_{(3-m)/2}$$

wherein m is a number from 0 to 2, R is a mono valent hydrocarbon radical and $R^1$ is selected from the group consisting of:

i) a unit of Formula A1

$$-(CH_2)_a-(\underset{\underset{R^2}{|}}{N}-CH_2CH_2)_b-\underset{\underset{R^2}{|}}{N}-R^2$$

wherein a is a number of at least 1, b is a number from 0 to 10, $R^2$ is $$-\underset{\underset{R^4}{|}}{CH}-\underset{\underset{OH}{|}}{CH}-R^3,$$

$R^3$ is a hydrocarbon radical having from 4 to 40 carbon atoms and $R^4$ is hydrogen or a hydrocarbon radical having from 1 to 40 carbon atoms; and ii) a unit of Formula A2

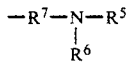

wherein $R^5$ and $R^6$ are independently selected from hydrogen or a hydrocarbon radical having from 1 to 45 carbon atoms and at least one of $R^5$ and $R^6$ is a hydrocarbon radical having from 6 to 45 carbon atoms, $R^7$ is

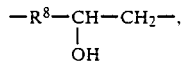

where $R^8$ is a divalent organic radical having from 1 to 12 carbon atoms, said particles characterized by being dispersible in a liquid.

* * * * *